US010390642B1

(12) United States Patent
Fraser

(10) Patent No.: US 10,390,642 B1
(45) Date of Patent: Aug. 27, 2019

(54) KNIFE HOLDER AND DISPLAY

(71) Applicant: Matthew John Fraser, New South Wales (AU)

(72) Inventor: Matthew John Fraser, New South Wales (AU)

( * ) Notice: Subject to any disclaimer, the term of this patent is extended or adjusted under 35 U.S.C. 154(b) by 0 days.

(21) Appl. No.: 16/021,452

(22) Filed: Jun. 28, 2018

(51) Int. Cl.

| | |
|---|---|
| ***A47G 21/14*** | (2006.01) |
| ***A47F 5/10*** | (2006.01) |
| ***A47F 7/00*** | (2006.01) |
| ***B65D 73/00*** | (2006.01) |

(52) U.S. Cl.
CPC ..... *A47G 21/14* (2013.01); *A47F 5/108* (2013.01); *A47F 7/00* (2013.01); *B65D 73/0078* (2013.01)

(58) Field of Classification Search
USPC ..... 206/745, 747, 748, 749, 750, 754, 249, 206/372, 373
See application file for complete search history.

(56) References Cited

U.S. PATENT DOCUMENTS

| | | | | |
|---|---|---|---|---|
| 2,788,827 | A * | 4/1957 | Banner | A47G 21/14 206/373 |
| 3,278,020 | A | 10/1966 | Murphy | |
| 3,487,922 | A * | 1/1970 | Peck | B65D 73/005 206/349 |
| 3,769,741 | A * | 11/1973 | Hessler | A01K 97/06 206/315.11 |
| 4,799,590 | A * | 1/1989 | Furman | B65D 1/30 206/390 |
| 5,676,253 | A * | 10/1997 | Hsu | B25H 3/023 206/372 |
| 6,269,961 | B1 * | 8/2001 | Porcelli | A47F 5/112 211/70.7 |
| 6,926,151 | B1 | 8/2005 | Perry et al. | |
| D516,312 | S * | 3/2006 | Chan | D3/273 |
| 7,273,148 | B2 * | 9/2007 | Perry | B65D 85/20 206/214 |
| 9,199,767 | B1 * | 12/2015 | Pheir | B65D 11/00 |
| 9,434,590 | B2 | 9/2016 | Miksovsky et al. | |
| 2003/0155277 | A1 * | 8/2003 | Cismoski | B65D 1/22 206/748 |
| 2005/0224392 | A1 * | 10/2005 | Perry | B65D 85/20 206/750 |

* cited by examiner

*Primary Examiner* — Jacob K Ackun
(74) *Attorney, Agent, or Firm* — Eric Karich; Karich & Associates

(57) ABSTRACT

A holder and display device includes three rectangular rigid panels, and a knife receiving structure formed on an inner surface of one of the rigid panels. A flexible sheet is attached to each of the rigid panels such that the flexible sheet hingably connects the rigid panels together, whereby the three panels may hinge with respect to each other via the flexible sheet between a closed configuration and a display configuration.

10 Claims, 2 Drawing Sheets

KNIFE HOLDER AND DISPLAY

BACKGROUND OF THE INVENTION

Field of the Invention

This invention relates generally to knife holders, and more particularly to a knife holder that is suitable for storing and shipping a knife, and which can be converted into a knife display for displaying the knife.

Description of Related Art

The prior art teaches generally rectangular knife holders, which are basically boxes for storing knives. When opened, some of the knife holders of the prior art are decorated so that the open box functions to display the knife.

The prior art does not teach, however, a three panel knife holder than can be invented to form an upright stand for prominently displaying the knife from a raised and tilted platform. The present invention fulfills these needs and provides further advantages as described in the following summary.

SUMMARY OF THE INVENTION

The present invention teaches certain benefits in construction and use which give rise to the objectives described below.

The present invention provides a holder and display device for a knife. The device includes three rigid panels. A knife receiving structure is formed on an inner surface of one of the rigid panels. A flexible sheet is attached to each of the rigid panels such that the flexible sheet hingably connects the rigid panels together, whereby the three panels may hinge with respect to each other via the flexible sheet between a closed configuration and a display configuration.

A primary objective of the present invention is to provide a holder and display device having advantages not taught by the prior art.

Another objective is to provide a holder and display device that can be used initially in a closed configuration for shipping and storage of a knife, and then converted to a display configuration for displaying the knife.

A further objective is to provide a holder and display device that holds the knife in a partially upright position for more prominent display of the knife.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a holder and display device 10 for a knife 12.

Figure 1:
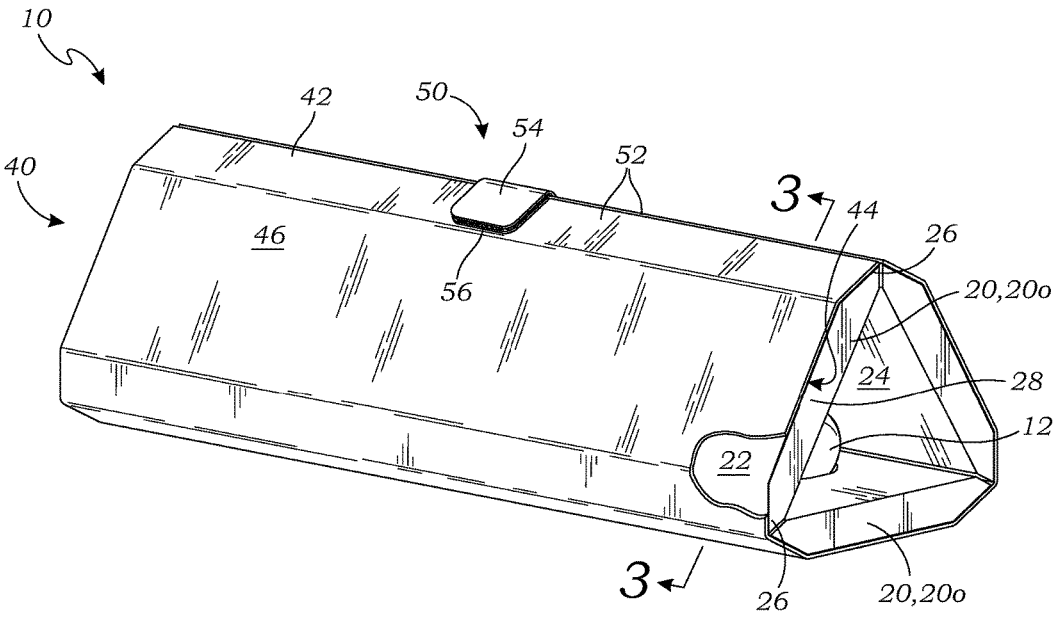
FIG. 1 is a front perspective view of one embodiment of a holder and display device for a knife, illustrating the device in a closed configuration for storing or shipping the knife.
Figure 2:
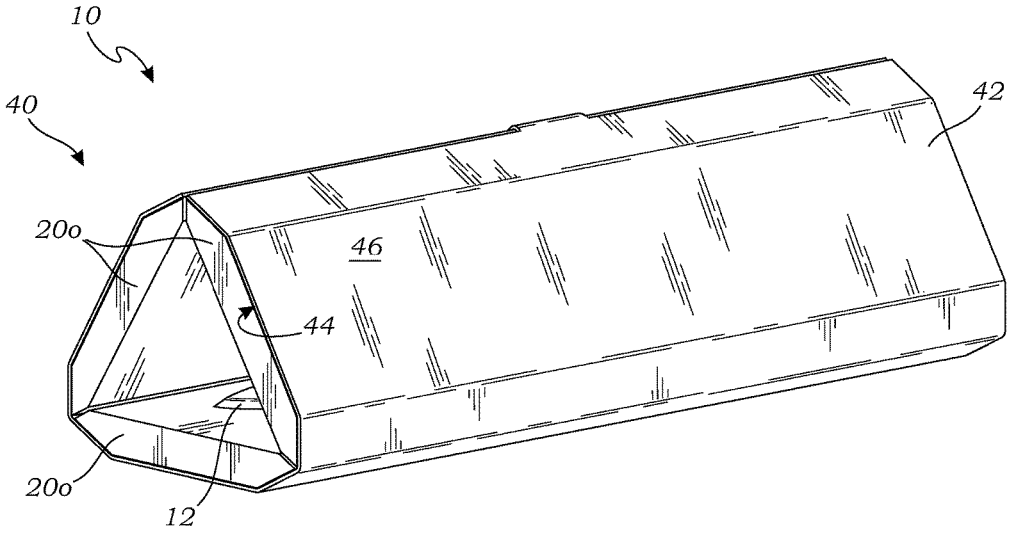
FIG. 2 is a rear perspective view thereof.
Figure 3:
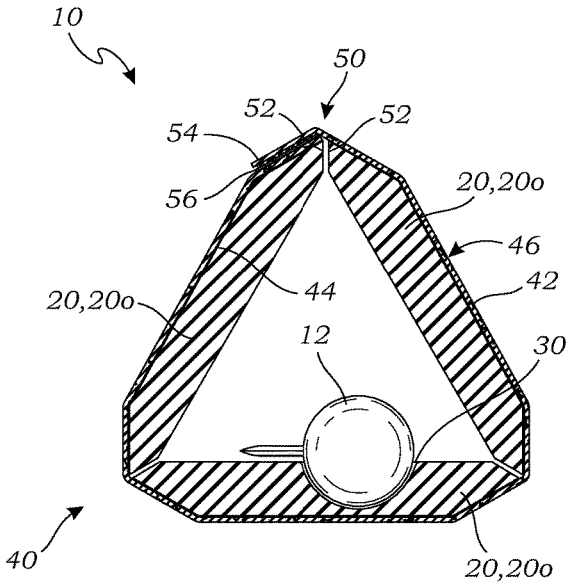
FIG. 3 is a sectional view thereof taken along line 3-3 in FIG. 1.

FIG. 1 is a front perspective view of one embodiment of the holder and display device 10, and FIG. 2 is a rear perspective view of the device 10, both views illustrating the device 10 in a closed configuration for storing or shipping the knife 12. FIG. 3 is a sectional view of the device 10 taken along line 3-3 in FIG. 1. As shown in FIGS. 1-3, when the device 10 is in the closed configuration, it is positioned around the knife 12 to contain and protect the knife 12 during shipping and storage.

Figure 4:
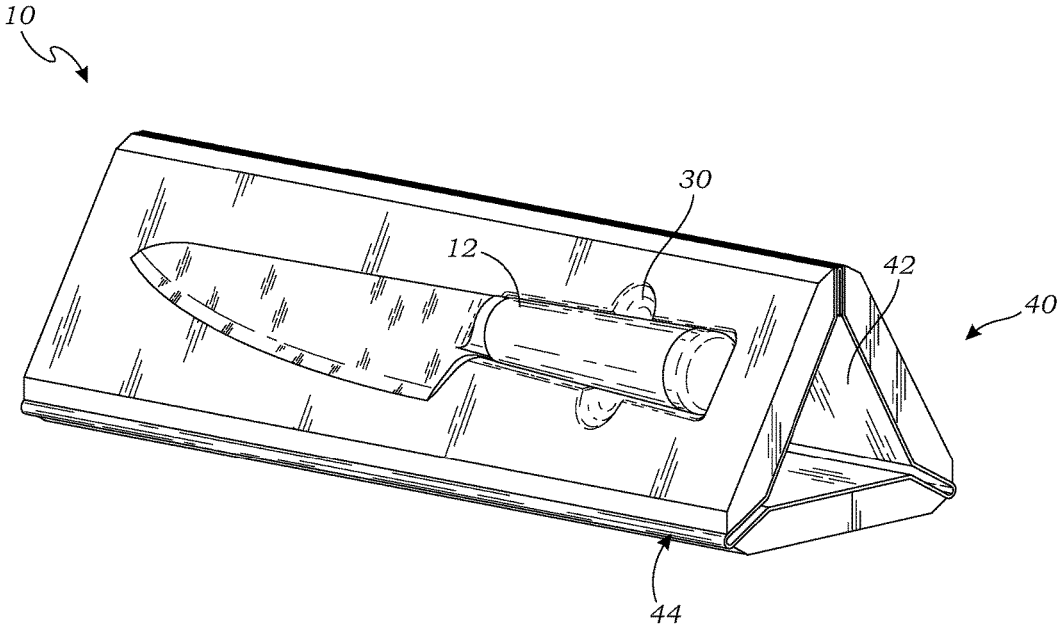
FIG. 4 is a front perspective view of the holder and display device, illustrating the device in a display configuration for displaying the knife.

FIG. 4 is a front perspective view of the device 10 in a display configuration for displaying the knife 12. In this configuration, the device 10 holds the knife 12 in a partially upright position that is suitable for prominently displaying the knife 12. For purposes of this application, the term "partially upright" means not horizontal, but at least partially vertical, in this case about 60 degrees.

As shown in FIGS. 1-4, the device 10 includes three rigid panels 20 that form the structure of the device 10. Each of the rigid panels 20 has an inner surface 22 and an outer surface 24 which extend to opposed side edges 26 and opposed end edges 28. In one embodiment, the rigid panels 20 are rectangular in shape, and the side edges 26 are beveled, although alternative shapes could potentially also be used. In the embodiment of FIGS. 1-4, there are exactly three rigid panels 20, although in alternative embodiments, four or more panels could be included. In the present embodiment, the rigid panels 20 are formed of wood, although other materials could also be used (e.g., plastic, metal, or other materials selected by one skilled in the art).

A knife receiving structure 30 is provided on the inner surface 22 of one of the rigid panels 20. The knife receiving structure 30 in this embodiment includes recesses shaped to receive the knife 12. In alternative embodiments, the knife receiving structure 30 may include other forms of hooks, fastening elements, straps, etc., which those skilled in the art can devise for holding the knife 12.

The device 10 further includes a means for hingably connecting the rigid panels 20 together so that the rigid panels 20 may hinge with respect to each other between the closed configuration (shown in FIGS. 1-3), wherein the rigid panels 20 form a tubular structure 40 with the knife receiving structure 30 being located within the tubular structure 40, and the display configuration (shown in FIG. 4), wherein the rigid panels 20 are inverted from the closed configuration and the knife receiving structure 30 is positioned on the outside of the tubular construction 40.

In this embodiment, the means for hingably connecting includes a flexible sheet 42 having a first surface 44 and an opposed second surface 46. In this embodiment, each of the rigid panels 20 is attached to the flexible sheet 42 such that the flexible sheet 42 enables the hinged movement. In this case, the outer surfaces 24 of the rigid panels 20 are attached to the first surface 44 of the flexible sheet 42. In this embodiment, the rigid panels 20 are bonded to the first surface 44 with an adhesive such as glue, cement, or any form of equivalent bonding agent. In this embodiment, the flexible sheet 42 is leather or other suitable material (e.g., fabric, flexible plastic sheet, etc.). In other embodiments, the flexible sheet 42 is attached with other forms of fasteners (e.g., screws, magnets, etc.) or other means known in the art.

In this embodiment, the rigid panels 20 are disposed in parallel formation when the device is flat (not shown) such that each of the side edges 26 of a center one 20*c* of the rigid panels 20 is adjacent one of the side edges 26 of one of the other rigid panels 20*o*, such that the flexible sheet 42 hingably connects the rigid panels 20 together. In this embodiment, the three panels may hinge with respect to each other via the flexible sheet 42 between the closed configuration and the display configuration.

As shown in FIGS. 1-4, the device 10 further comprises a fastener 50 for connecting side edges 52 of the flexible sheet 42, for fastening the device 10 in either the closed configuration or the display configuration. In this embodiment, the fastener 50 includes a tab 54 that extends outwardly from one of the side edges 52 of the flexible sheet 42, and a fastener material 56 (e.g., hooks and loops fasteners 50, snaps, etc.). In alternative embodiments, other fasteners 50 known in the art may be used.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A holder and display device for a knife, the device comprising:

three rigid panels, each of the rigid panels having an inner surface and an outer surface;

a knife receiving structure formed on the inner surface of one of the rigid panels; and a means for hingably connecting the rigid panels together so that the three panels may hinge with respect to each other between a closed configuration wherein the rigid panels form a tubular structure with the knife receiving structure being located within the tubular structure, and a display configuration wherein the rigid panels are inverted from the closed configuration and the knife receiving structure is positioned on the outside of the tubular construction.

2. The device of claim 1, wherein the means for hingably connecting is a flexible sheet.

3. The device of claim 2, wherein the flexible sheet includes a first surface bonded to the rigid panels, and a second surface.

4. The device of claim 3, wherein the flexible sheet is leather.

5. The device of claim 1, further comprising a fastener for connecting side edges of the flexible sheet, for fastening the device in either the closed configuration or the display configuration.

6. A holder and display device for a knife, the device comprising:

three rectangular rigid panels, each of the rigid panels having an inner surface and an outer surface which extend to opposed side edges and opposed end edges;

a knife receiving structure formed on the inner surface of one of the rigid panels;

a flexible sheet having a first surface and an opposed second surface, each of the rigid panels being attached to the flexible sheet such that the outer surfaces of the rigid panels are attached to the first surface of the flexible sheet;

the rigid panels being disposed in parallel formation such that each of the side edges of a center one of the rigid panels is adjacent one of the side edges of one of the other rigid panels, such that the flexible sheet hingably connects the rigid panels together; and whereby the three panels may hinge with respect to each other via the flexible sheet between a closed configuration wherein the rigid panels form a tubular structure with the knife receiving structure being located within the tubular structure, and a display configuration wherein the rigid panels are inverted from the closed configuration and the knife receiving structure is positioned on the outside of the tubular construction, to prominently display the knife when positioned on the knife receiving structure.

7. The device of claim 6, wherein the flexible sheet includes a first surface bonded to the rigid panels, and a second surface.

8. The device of claim 6, wherein the flexible sheet is leather.

9. The device of claim 6, further comprising a fastener for connecting side edges of the flexible sheet, for fastening the device in either the closed configuration or the display configuration.

10. A holder and display device comprising:

three rectangular rigid panels, each of the rigid panels having an inner surface and an outer surface which extend to opposed side edges and opposed end edges;

a knife receiving structure formed on the inner surface of one of the rigid panels;

a knife removably mounted in the knife receiving structure;

a flexible sheet having a first surface and an opposed second surface, each of the rigid panels being attached to the flexible sheet such that the outer surfaces of the rigid panels are attached to the first surface of the flexible sheet;

the rigid panels being disposed in parallel formation such that each of the side edges of a center one of the rigid panels is adjacent one of the side edges of one of the other rigid panels, such that the flexible sheet hingably connects the rigid panels together; and whereby the three panels may hinge with respect to each other via the flexible sheet between a closed configuration wherein the rigid panels form a tubular structure with the knife receiving structure being located within the tubular structure, and a display configuration wherein the rigid panels are inverted from the closed configuration and the knife receiving structure is positioned on the outside of the tubular construction, to prominently display the knife when positioned on the knife receiving structure.

* * * * *